US005749714A

United States Patent [19]

Lee

[11] Patent Number: 5,749,714

[45] Date of Patent: May 12, 1998

[54] MUFFLER FOR A RECIPROCATING COMPRESSOR

[75] Inventor: Sung Tae Lee, Suwon, Rep. of Korea

[73] Assignee: Samsung Electronics Co., Ltd., Suwon, Rep. of Korea

[21] Appl. No.: 760,718

[22] Filed: Dec. 5, 1996

[30] Foreign Application Priority Data

Dec. 5, 1995 [KR] Rep. of Korea ..... 95-46748

[51] Int. Cl.[6] ..... F04B 39/00

[52] U.S. Cl. ..... 417/312; 417/540; 181/403; 62/296

[58] Field of Search ..... 417/312, 313, 417/540; 181/403; 62/296

[56] References Cited

U.S. PATENT DOCUMENTS 4,477,229 10/1984 Kropiwnicki et al. ..... 181/403

FOREIGN PATENT DOCUMENTS 6-257567 A 9/1994 Japan ..... 417/312

*Primary Examiner*—Charles G. Freay
*Assistant Examiner*—Cheryl J. Tyler
*Attorney, Agent, or Firm*—Burns, Doane, Swecker & Mathis, L.L.P.

[57] ABSTRACT

A reciprocating compressor includes a piston mounted for reciprocation in a bore of a cylinder. A cylinder head is mounted on the cylinder at one end of the bore for conducting fluid to and from the bore. A muffler is connected to the cylinder head for conducting the fluid to the bore. The muffler includes a base member and a muffler body secured thereto. The base member includes a recess in which a leading portion of the muffler body is installed. Hooks formed on the leading portion become caught against securing edges formed in the recess to resist rearward withdrawal of the muffler body. A floor of the body is elastic, to push the hooks against the securing edges. Also, side walls of the recess push elastically against the leading portion of the muffler body. Consequently, there is no play between the muffler body and base member which could produce noisy rattling during operation of the compressor.

7 Claims, 5 Drawing Sheets

MUFFLER FOR A RECIPROCATING COMPRESSOR

BACKGROUND OF THE INVENTION

The present invention relates to a hermetic reciprocating compressor, and more particularly, to a hermetic reciprocating compressor which can facilitate assembly and can prevent vibration and noise in use.

As shown in FIGS. 1 and 2, a general hermetic reciprocating compressor widely used for compressing a coolant of a refrigerator or an air conditioner includes a drive motor having a stator 2 fixedly installed in a casing 1, a rotor 3 rotatably installed in the stator 2 and a rotating shift 4 fixed to the rotor 2 and rotating together with the rotor 2. The rotating shaft 4 of the drive motor is rotatably supported by a bearing 6 provided on one side of a cylinder block 5. A piston 9 is contained in the cylinder block 5 and is reciprocated therein. The piston 9 is connected to a crank shaft formed on the lower end of the rotating shaft 4, via a connecting rod, and is reciprocated in the cylinder block 5 along with rotation of the rotating shaft 4, to thereby compress a medium such as a coolant sucked into the cylinder block 5. A cylinder head 8 is installed at one end of the cylinder block 5 and a suction muffler is connected to the cylinder head 8.

The suction muffler is constituted by a muffler body 7 for forming an accommodation space of a medium, and a base member 10 integrally connected with the muffler body 7 as shown in FIG. 3. A suction tube 13 introduced through the casing 1 has an end 12 with the muffler body 7 An opening is formed in the lower leading end of the muffler body 7. The lower end of the muffler body 7 is accommodated in a guide portion 11 provided in the base member 10. Hook projections 7*a* and 7*b* which are protruded outwards are formed on outer surface of a side wall in the leading end toward the inserting the muffler body 7. Meanwhile, latching grooves 11A and 11B are formed in the guide portion 11 of the base member 10 in correspondence to the hook projections 7*a* and 7*b*. When the lower leading end portion of the muffler body 7 is inserted into the guide portion 11, the hook projections 7*a* and 7*b* and the latching grooves 11*a* and 11*b* are engaged with each other to prevent detachment from each other. A tubular member 11*c* extended downwards from the guide portion 11 of the base member 10 is inserted into an accommodation groove 8*g* provided in a cylinder head 8. The cylinder head 8 is fixed to the cylinder block 5 via a valve seat 8*a*. Suction holes and discharge holes are formed on the valve seat 8*a*. A suction valve plate 8*b* for opening and closing the suction holes is interposed between the valve seat 8*a* and the cylinder block 5. A discharge valve reed 8*c*, a stopper 8*d*, a keeper 8*e*, and a gasket 8*f* are in turn installed toward the side of the cylinder head 8 of the valve seat 8*a*.

In the above hermetic reciprocating compressor, the muffler body 7 of suction muffler and the base member 10 are mutually connected in the form of a hook, as shown as a partially sectional view in FIG. 4 By the way, since the guide portion 11 of the base member 10 is closed on the bottom thereof, a height H from the lower-side portion 7*e* of the muffler body 7 to the hook projections 7*a* and 7*b* should be smaller than a height from the bottom surface 11*d* of the guide portion 11 of the base member 10 to the upper-side portion of the latching grooves 11*a* and 11*b*, in order to latch the hook projections 7*a* and 7*b* within the latching grooves 11*a* and 11*b*. As a result, a gap G exists inevitably between the leading end 7*c* of the muffler body 7 and the bottom surface 11*d* of the guide portion 11, when the muffler body 7 is mutually connected with the base member 10, as shown in FIG. 5, to thereby cause the muffler body 7 to vibrate up and down with respect to the base member 10 during operation of the compressor, and to increase noise due to the vibration thereof. When the gap G is reduced, it is difficult to mutually connect the muffler body 7 and the base member 10, to thereby complicates the assembling step.

Furthermore, since the guide portion 11 of the base member 10 has a tubular shape to tightly accommodate the leading portion of the muffler body 7, there is little dimensional tolerance therebetween. This also complicates assembling step and reduces the dimensional flexiblity of the corresponding parts.

SUMMARY OF THE INVENTION

To solve the above problem, it is an object of the present invention to provide a hermetic reciprocating compressor in which the assembling of base member 40 a muffler body can be easily performed and vibration and noise can be prevented because no gap is formed at the assembled state.

To accomplish the above object of the present invention, there is provided a hermetic reciprocating compressor including a piston, a cylinder for accommodating and reciprocating the piston, a cylinder bead fixed to the cylinder; and a suction muffler fixed to the cylinder head, wherein said suction muffler comprises: a muffler body which is connected to a suction tube for receiving a gas medium to be compressed; a base member having a tubular member whose one end is fixed to the cylinder head, and a guide portion which is formed in the other end of the tubular member to accomodate the leading end portion of the muffler body; and means for resiliently urging a leading end surface of the muffler body in the opposite direction to the connection direction of the muffler body with the base member.

Here, the resiliently urging means may be cantilever supports formed on the base member to resiliently contact with the leading end surface of the muffler body. Contact projections may be preferrably formed on the cantilever supports to contact the leading end surface of the muffler body.

It is preferrable that hook projections are formed on the outer surface (if the muffler body, and look latching portions for engaging with the hook projections are formed on the inner surface of the guide portion.

To improve dimensional adaptability between the muffler body and the the guide portion, it is highly preferrable that the guide portion contacts resiliently on the outer surfaces of facing side walls of the muffler body.

DETAILED DESCRIPTION OF THE PREFERRED EMBODIMENT

Figure 1:
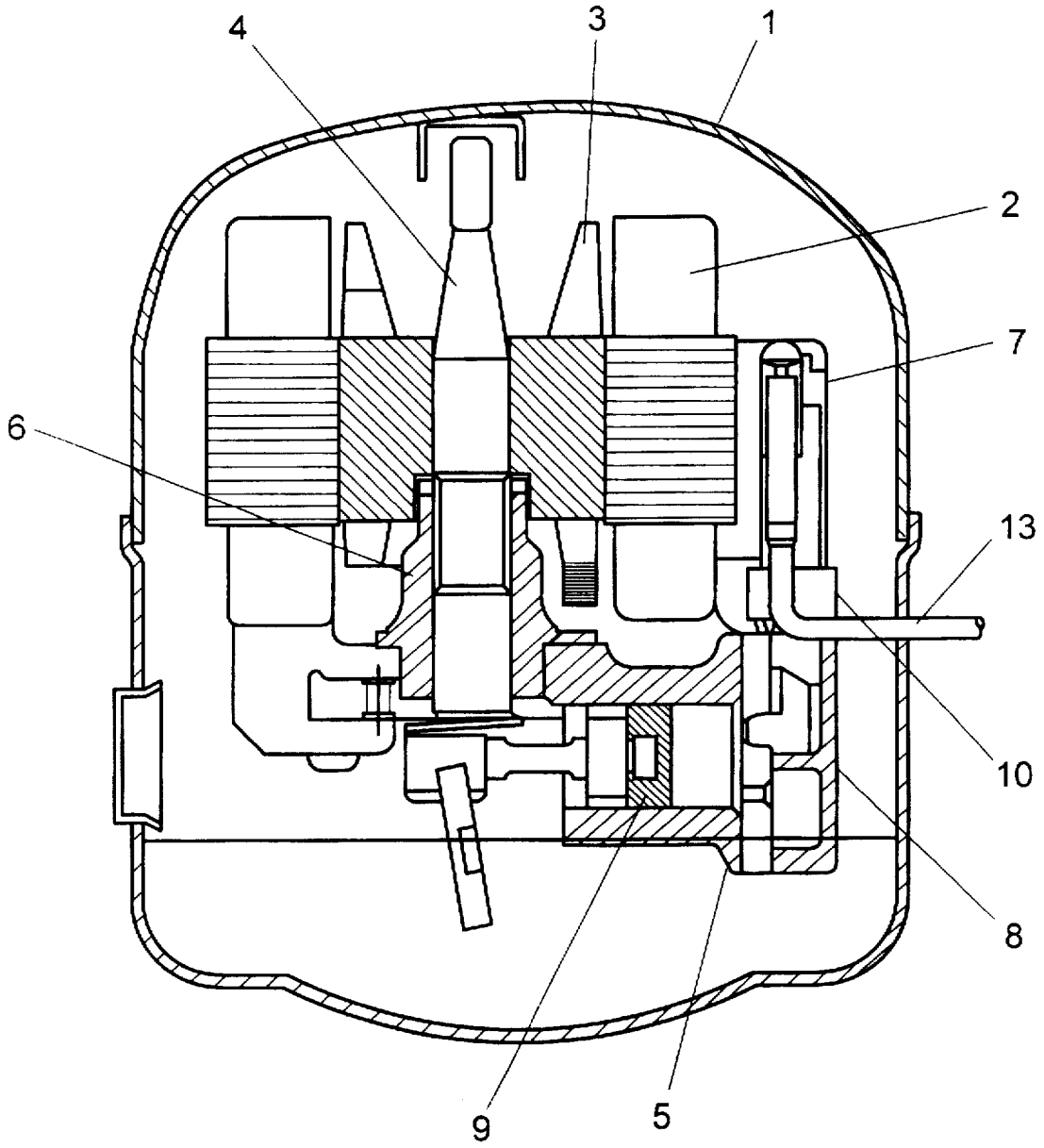
FIG. 1 (PRIOR ART)
FIGS. 1 and 2 are a front view and a side sectional view of a general hermetic reciprocating compressor, respectively.
Figure 2:
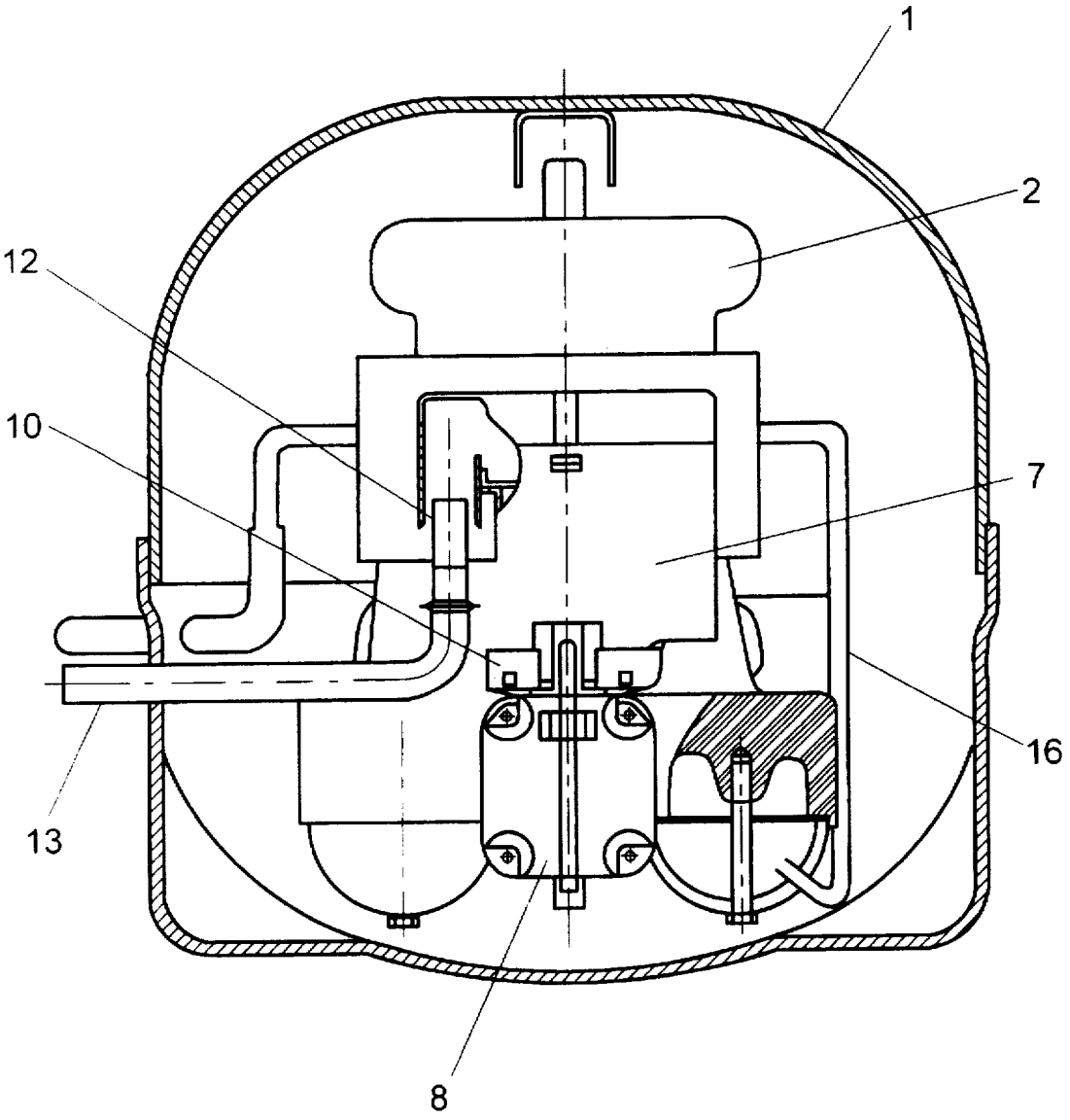
FIG. 2 (PRIOR ART)
Figure 3:
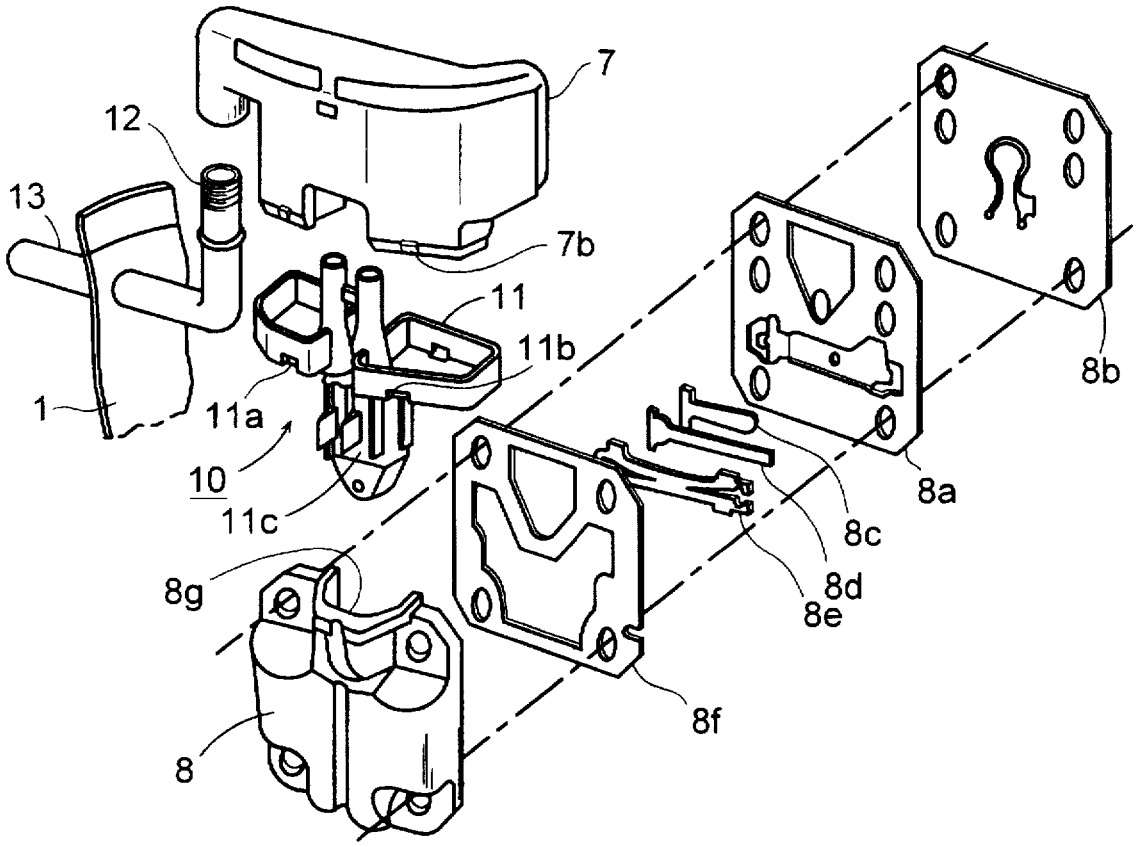
FIG. 3 (PRIOR ART)
FIG. 3 is an exploded perspective view of the suction muffler and the cylinder head portion of the conventional hermetic reciprocating compressor.
Figure 4:
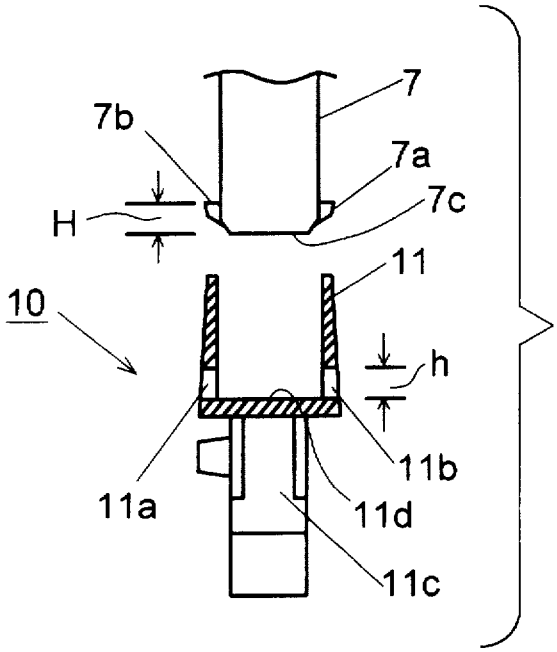
FIG. 4 (PRIOR ART)
FIG. 4 is an exploded, a partial sectional view of the suction muffler shown in FIG. 2 when the muffler body and the base member are separated from each other.
Figure 5:
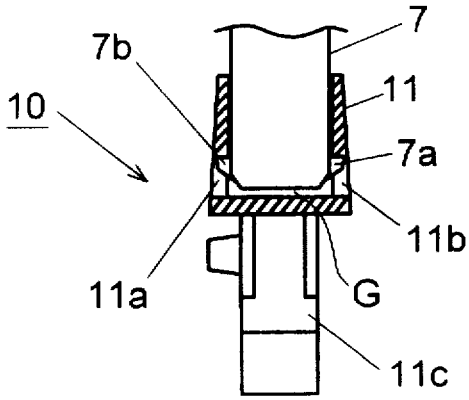
FIG. 5 (PRIOR ART)
FIG. 5 is a sectional view of the suction muffler in an assembled state of the muffler body and the base member.

A preferred embodiment of the present invention will be described below in more detail with reference to the accompanying drawings. In the drawings of the embodiment of the present invention, the same reference numerals are assigned to the same elements as those of the conventional hermetic reciprocating compressor described referring to FIGS. 1–5.

Figure 6:
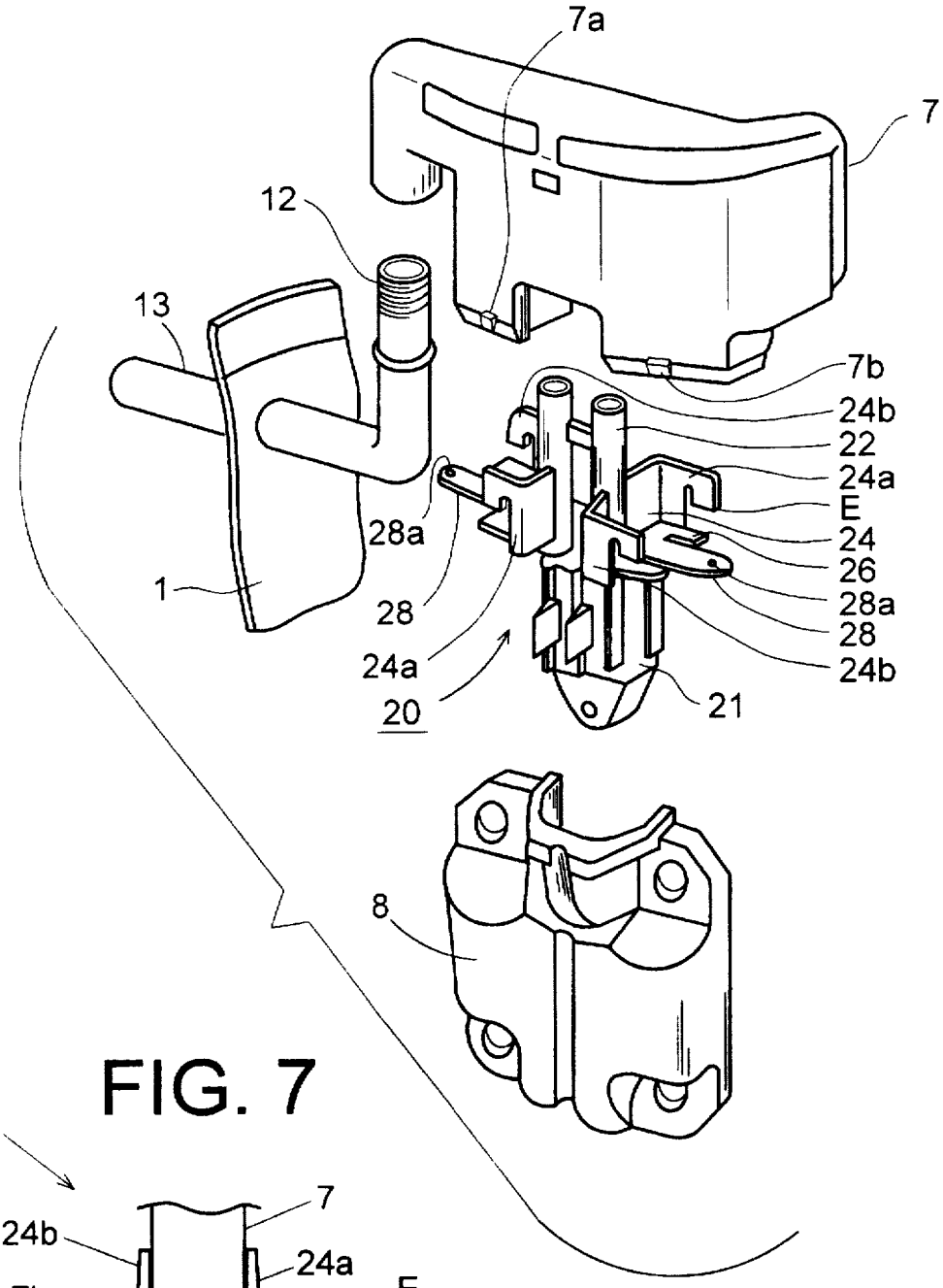
FIG. 6 is an exploded perspective view of the suction muffler of a hermetic reciprocating compressor according to the present invention.

FIG. 6 is an exploded perspective view of the suction muffler of a hermetic reciprocating compressor according to the present invention. A suction muffler in the embodiment includes a muffler body 7 and a base member 20 connected to the muffler body 7, in the same manner as those of the FIG. 2 constitution. An end 12 of a suction tube 13 introduced via a casing 1 is connected to the muffler body 7. Two connection portions which are extended downwards from the muffler body 7 to be connected to the base member 20 are formed in the lower leading side of the muffler body 7. Hook projections 7*a* and 7*b* are formed on the outer surface of the lower-side leading end portion of these connection portions.

The base member 20 has a tubular member 21 to be fixed to the cylinder head 8 and baffles 22 accommodated in the muffler body 7. Guide portions 24 for guiding the lower-side leading end portion of the muffler body 7 are opposingly formed on the baffles 22 in a generally U-shape form. The leading end portion of the muffler body 7 is accommodated in the guide portion 24. Two elastic pieces 24*a* and 24*b* of the guide portion 24 resiliently contract the outer wall of the muffler body 7. Both elastic pieces 24*a* and 24*b* are engaged by hook projections 7*a* and 7*b* of the muffler body 7.

Cantilever supports 28 for contacting the leading end of the muffler body 7 are formed on a bottom plate 26 of the guide portion 24. The cantilever supports 28 are extended outwards from the baffles 22, respectively. Contact projections 28*a* which are protruded upwards are formed on the upper surfaces of the free end portions of the cantilever supports 28. The contact projections 28*a* contact the lead end surface of the muffler body 7 when the muffler body 7 is connected to the base member 20.

When the muffler body 7 is inserted in the axial direction of the base member 20 when the muffler body 7 is connected to the base member 20 the leading end portion of the muffler body 7 is accommodated in the guide portion 24, and the leading end surface of the muffler body 7 press against the cantilever supports 28. Accordingly, the cantilever supports 28 are elastically deformed. In response to deformation of the cantilever supports 28, securing surface of the hook projections 7*a* and 7*b* are latched to securing surfaces of the elastic pieces 24*a* and 24*b*, to thereby prevent detachment of the muffler body 7 in a direction opposing the inserting direction.

Figure 7:
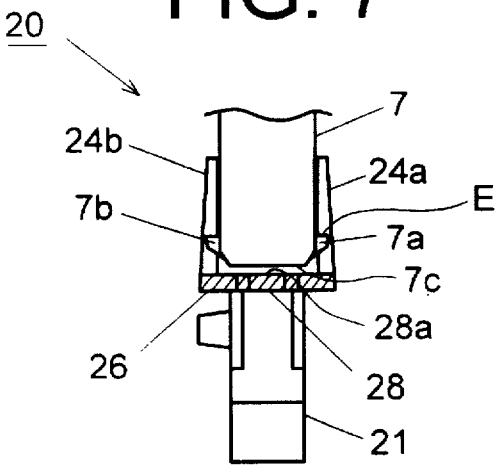
FIG. 7 is a partial sectional view of the suction muffler of FIG. 6 when the muffler body and the base member are connected with each other.

FIG. 7 is a partial sectional view of the suction muffler when the muffler body 7 and the base member 20 are connected with each other. As call be seen from FIG. 6, the hook projections 7*a* and 7*b* of the muffler body 7 are latched to respective edge E of the elastic side pieces 24*a* and 24*b*. The elastic side pieces 24*a* and 24*b* of the guide portion 24 resiliently press against the side wall of the muffler body 7 to prevent play of the muffler body 7 in the lateral direction. The contact projections 28*a* of the cantilever supports 28 contact the leading end surface of the muffler body 7. The elastic cantilever supports 28 resiliently press against the leading end surface 7*c* of the muffler 7 via the contract projections 28*a*. Accordingly, the muffler body 7 does not create any vertical (forward-rearward) gaps with the base member 20.

As described above, since the muffler body 7 is resiliently pressed in a rearward direction opposing a forward insertion direction by the cantilever supports 28 formed in the base member 20, surfaces of the hook projections 7*a*, 7*b* are pressed against the edges E. Hence, any gap or play in which the muffler body 7 can move forwardly or rearwardly disappears. Accordingly, the muffler body 7 is prevented from up and down movement relative to the base member 20 during operation of the compressor. Also, when the muffler body 7 is mutually connected with the base member 20, the cantilever supports 28 are resiliently deformed, to facilitate an assembly operation thereof.

As described above, the hermetic reciprocating compressor according to the present invention establishes a state where the muffler body is tightly fixed to the base member, to thereby prevent the generation of noise due to vibration of the compressor and to enable a silent operation and improve an assembly efficiency.

What is claimed is:

1. A reciprocating compressor comprising:

a cylinder forming a bore for receiving gaseous refrigerant;

a piston mounted for reciprocation in the bore for compressing the gaseous refrigerant;

a cylinder head mounted on the cylinder at one end of the bore for conducting for conducting gas to and from the bore;

a suction muffler connected to the cylinder head and comprising:

a muffler body for receiving gas to be compressed, and a base member fixed to the cylinder head for delivering the gas to the bore, the base member being connected to a leading portion of the muffler body which is installed in the base member in a forward direction of installation, the leading portion and base member including mutually engageable securing surfaces securing the muffler body to the base member, the base member including an elastic element pushing elastically against the muffler body in a rearward direction opposite the forward direction of installation for pressing the mutually engageable securing surfaces against one another to prevent relative movement between the muffler body and base member in forward and rearward directions.

2. The reciprocating compressor according to claim 1 wherein the base member includes a recess receiving the leading portion of the muffler body.

3. The reciprocating compressor according to claim 2 wherein the recess includes a floor toward which the muffler body approaches in the direction of installation, the floor comprising a cantilever-mounted member defining the elastic element, the floor engaging a leading surface of the leading portion.

4. The reciprocating compressor according to claim 3 wherein the floor includes a projection extending toward, and contacting, the leading surface.

5. The reciprocating compressor according to claim 1 wherein the base member and muffler body are secured together by hooks formed on one of the base member and muffler and by engaging edges formed on the other of the base member and muffler body, the hooks and edges defining the mutually engageable securing surfaces.

6. The reciprocating compressor according to claim 2 wherein the recess includes side pieces which press elastically against the muffler body.

7. The reciprocating compressor according to claim 2 wherein the muffler body includes a pair of side-by-side leading portions, and the base member includes a pair of the recesses for receiving respective ones of the leading portions.

* * * * *